US007784676B2

(12) United States Patent
Borek et al.

(10) Patent No.: US 7,784,676 B2
(45) Date of Patent: Aug. 31, 2010

(54) CARTON HAVING TEAR-AWAY FEATURE FOR SHIPPING AND HANDLING MULTIPLE PACKAGES OF PRODUCTS

(75) Inventors: Rick Borek, Sugar Hill, GA (US); Jody Brittain, North Augusta, SC (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 369 days.

(21) Appl. No.: 11/556,298

(22) Filed: Nov. 3, 2006

(65) Prior Publication Data

US 2007/0102497 A1 May 10, 2007

Related U.S. Application Data

(60) Provisional application No. 60/734,381, filed on Nov. 7, 2005.

(51) Int. Cl.
*B65D 17/28* (2006.01)
*B65D 5/32* (2006.01)

(52) U.S. Cl. ..... 229/242; 229/117.16; 229/122.24; 229/162.6; 229/240

(58) Field of Classification Search ..... 229/240, 229/242, 117.16, 122.24, 122.26, 243, 244, 229/103.2, 162.1, 162.6; 206/427
See application file for complete search history.

(56) References Cited

U.S. PATENT DOCUMENTS 3,004,697 A * 10/1961 Stone ..... 229/242
3,829,006 A * 8/1974 Spiegel ..... 229/242
3,850,362 A * 11/1974 Stollberg et al. ..... 229/117.06
4,003,514 A * 1/1977 Graser ..... 229/123.2
4,449,633 A * 5/1984 Johnson et al. ..... 229/242
4,508,258 A * 4/1985 Graser ..... 229/103.2
4,566,593 A * 1/1986 Muller ..... 229/240
4,584,202 A 4/1986 Roccaforte
4,793,494 A * 12/1988 Gordon, Jr. ..... 229/240
4,946,042 A * 8/1990 Ferreri et al. ..... 229/241
4,948,033 A * 8/1990 Halsell et al. ..... 229/122.33
5,350,109 A * 9/1994 Brown et al. ..... 229/117.16
5,775,572 A * 7/1998 Oliff ..... 229/120.03
5,853,120 A 12/1998 McLeod et al.
5,979,746 A 11/1999 McLeod et al.
6,405,921 B1 6/2002 Cochrane
6,981,631 B2 * 1/2006 Fogle et al. ..... 229/241
7,000,824 B2 * 2/2006 Saulas ..... 229/244
2002/0134827 A1 * 9/2002 Sinclair et al. ..... 229/240
2005/0263574 A1 * 12/2005 Schuster ..... 229/242
2006/0060643 A1 * 3/2006 Sheffer ..... 229/242
2006/0081691 A1 * 4/2006 Smalley ..... 229/240
2006/0113364 A1 * 6/2006 Bonner et al. ..... 229/122.24

OTHER PUBLICATIONS

PCT Int'l Search Report PCT/US2006/060592.

* cited by examiner

*Primary Examiner*—Gary E Elkins
(74) *Attorney, Agent, or Firm*—Joel T. Charlton

(57) ABSTRACT

A carton is provided that may be used for multiple packages of various products, such as food snack items, and includes a tear-away feature that allows ready access to and display of the products. The carton in its open/display configuration still has sufficient strength to allow other cartons to be stacked on top of each other. The carton may be formed from a blank of paperboard or corrugated board.

7 Claims, 6 Drawing Sheets

CARTON HAVING TEAR-AWAY FEATURE FOR SHIPPING AND HANDLING MULTIPLE PACKAGES OF PRODUCTS

This application claims the benefit of U.S. Provisional Application Ser. No. 60/734,381 filed Nov. 7, 2005, the entire contents of which are hereby expressly incorporated by reference.

TECHNICAL FIELD

This invention relates generally to cartons, and blanks for forming such cartons, for shipping and handling various products. Such products can include, for example, packages of food snack products. The carton of this invention uses reduced amounts of material to form the carton and incorporates a tear-away feature that provides easy access to the products contained in the carton.

BACKGROUND

Manufacturers typically ship products, individual items or products packaged in small boxes, in a variety of different types of light weight paperboard containers. One particular type of carton has a wrap-around style. In this type of a carton, the product to be shipped and handled is placed on a portion of the carton blank that forms the bottom of the carton. The carton is then formed around the product by gluing the appropriate portions of the blank together. This style of carton is used mainly because it is easy to load and thus provides production efficiencies. For example, wrap-around style cartons can be run at higher speeds, there is less downtime when these styles of cartons are run and they tend to be less expensive.

Another carton style that is machine assembled is a bliss style carton, which is formed from multiple blanks. In this style, the main wrapper blank is joined to the other blank pieces before the product is loaded into it. This style of carton is popular because it has stacking strength and is display-ready, i.e. it can be easily converted to a configuration that allows the products inside the carton to be displayed for sale to the ultimate consumer. Most of these styles of cartons typically work for their intended purpose but they could be improved. For example, the materials used to manufacture the cartons can be a significant source of cost for carton manufacturers. Thus, these cartons could be improved if lesser amounts of material were used to form the carton without adversely affecting the structural integrity of the resulting carton or decreasing the volume of product that can be located inside the carton. In addition, when the carton is converted to a display configuration, some of the strength of the carton can be compromised because a significant amount of carton material must be removed to allow display of the products. Finally, the carton typically is not stackable after the carton has been converted to its display configuration because of the significant amount of the carton material that has been removed.

SUMMARY

The carton of this invention is formed from a blank that efficiently uses the raw material for forming the blank. The blank includes perforations and fold lines that allow a display ready carton to be formed with minimal effort. The resulting carton is display ready, allows easy access to the products contained therein and is capable of containing an appropriate volume of products therein. In addition, with the carton converted to its display configuration, the carton still has the desired physical properties to store the products contained therein and allows multiple cartons to be stacked on top of each other.

BRIEF DESCRIPTION OF THE DRAWINGS

The invention will be described in detail in the following description of preferred embodiments with reference to the following figures in which like reference numbers refer to like parts and wherein.

DETAILED DESCRIPTION OF THE PREFERRED EMBODIMENTS

The various aspects of the invention may be embodied in various forms. The following description shows by way of illustration various embodiments in which aspects of the invention may be practiced. It is to be understood that other embodiments may be utilized and structural and functional modifications may be made without departing from the scope of the present invention. In addition, it is to be understood that various different types of products, such as motor oil, can be located in the carton, and food snack products are just an example of a product that can be stored, shipped and displayed in the cartons of this invention.

The blanks for the various embodiments of the cartons of this invention are cost-effective because they each have a compact design that has very little wasted material. This can be seen by the minimal empty space located within the outer periphery of the blank. Reducing the amount of blank material used to form the unitary blank reduces the amount of substrate used, thereby reducing manufacturing costs. In each of the FIGS., the dotted lines on the blank represent either fold lines about which the blank may be folded to form. the desired carton or perforation lines that allow the blank material to be removed to allow easy access to the products stored and shipped in the carton or both. The description of such lines hereinafter will identify whether the lines are fold lines, perforation lines or both. As used herein, a fold line may be a thin band of a weaken region of material. The thin band can be formed by conventional manufacturing methods in the paperboard art. Alternatively, the fold line may be simply a predetermined line for folding of the blank without a weaken area. Perforations are formed from a cutting die that has a number of cutting surfaces. These cutting surfaces cut or slit the material to form the perforations.

Figure 1:
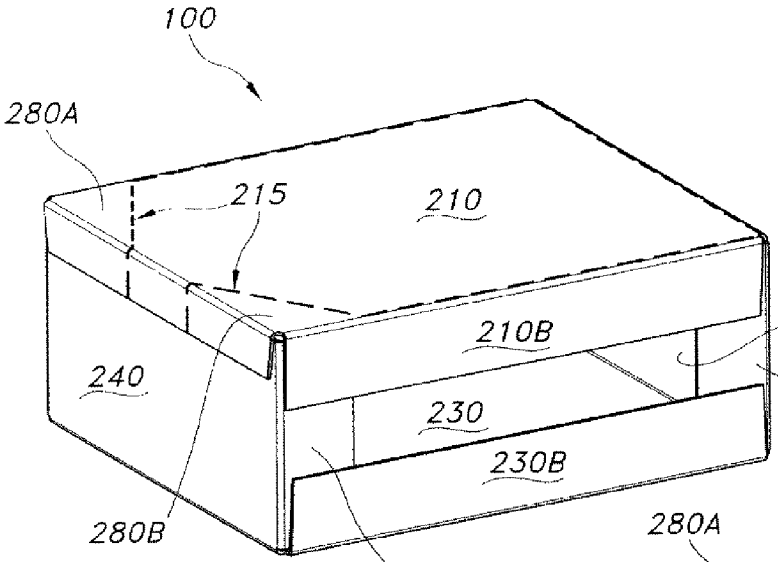
FIG. 1 is a perspective view of a first embodiment of the carton of this invention in its shipping configuration.
Figure 2:
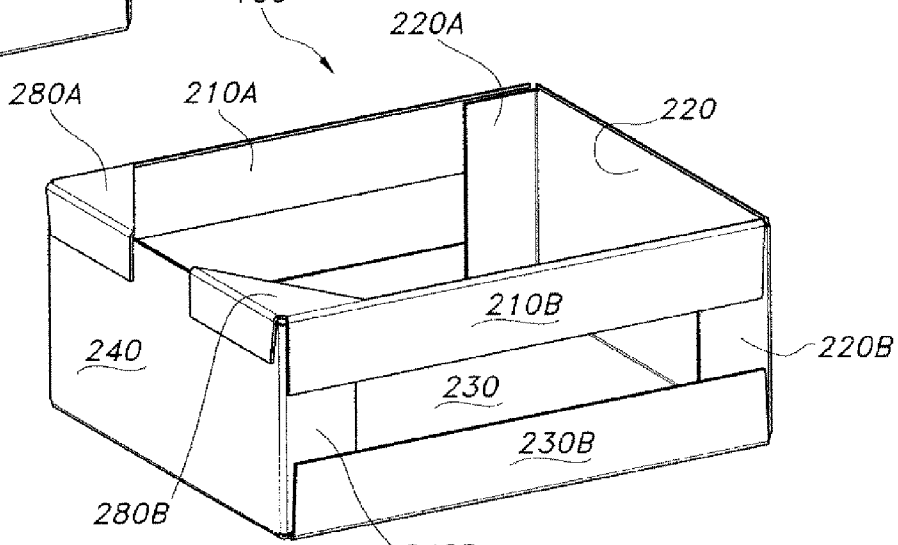
FIG. 2 is a perspective view of the first embodiment of the carton of this invention in its open/display configuration.

In the first embodiment of the carton of this invention shown in FIGS. 1 and 2, the carton 100 is assembled by folding and adhering together portions of the blank 200. One significant aspect of this embodiment of the invention is that the entire carton 100 can be formed with one blank. This eliminates the need for separate tops and bottoms and thus separate blanks are unnecessary. In order to gain access to the contents of carton 100, perforation line 215 is formed in blank 200 along a portion of the top perimeter of carton 100 and across two corners thereof to create an easy opening top for carton 100. Although not preferred, this invention contemplates that the perforation line does not extend along the perimeter of the carton but could be located inward of the perimeter and that the perforation line does not extend completely around the top of the carton. However, in each of these alternate embodiments, the access opening created by the perforation line should be large enough to provide easy access to the products contained in the carton.

Blank 200 includes four main panels, a top panel 210, a first end panel 220, a bottom panel 230 and a second end panel 240. Blank 200 also includes an adhesive tab 250, which is connected along its right side to the left side of top panel 210 along a first vertical fold line 201. Top panel 210 is connected along its right side to the left side of first end panel 220 along a second vertical fold line 202. First end panel 220 is connected along its right side to the left side of bottom panel 230 along a third vertical fold line 203. Bottom panel 230 is connected along its right side to the left side of second end panel 240 along a fourth vertical fold line 204. Each of top panel 210, first end panel 220, bottom panel 230, and second end panel 240 includes a top flap defined above a first horizontal fold line 260 and a bottom flap defined below a second horizontal fold line 270. Top panel top flap 210A is adjacent to top panel 210 above first horizontal fold line 260 while top panel bottom flap 210B is adjacent to top panel 210 below second horizontal fold line 270. First end panel top flap 220A is adjacent to first end panel 220 above first horizontal fold line 260 while first end panel bottom flap 220B is adjacent to first end panel 220 below second horizontal fold line 270. Bottom panel top flap 230A is adjacent to bottom panel 230 above first horizontal fold line 260 while bottom panel bottom flap 230B is adjacent to bottom panel 230 below second horizontal fold line 270. Second end panel top flap 240A is adjacent to second end panel 240 above first horizontal fold line 260 while second end panel bottom flap 240B is adjacent to second end panel 240 below second horizontal fold line 270.

Preferably, all of the top and bottom flaps, i.e. top panel top flap 210A, top panel bottom flap 210B, first end panel top flap 220A, first end panel bottom flap 220B, bottom panel top flap 230A, bottom panel bottom flap 230B, second end panel top flap 240A, and second end panel bottom flap 240B have substantially the same height. Preferably, top panel top flap 210A, top panel bottom flap 210B, bottom panel top flap 230A and bottom panel bottom flap 230B have substantially the same width. Preferably, first end panel top flap 220A, first end panel bottom flap 220B, second end panel top flap 240A and second end panel bottom flap 240B also have substantially the same width.

Perforation line 215 is formed in top panel 210 and extends diagonally across the two left corners of that panel. Preferably, perforation line 215 extends from an upper portion of the left end of adhesive tab 250 generally perpendicular thereto to first vertical fold line 201, then diagonally to a left portion of first horizontal fold line 260, along first horizontal fold line 260 to and along second vertical fold line 202 toward and along second horizontal fold line 270 toward adhesive tab 250, then, at a point long the left portion of second horizontal fold line 270, diagonally to a lower portion of first vertical line 201 and then, at a point along the lower portion of first vertical fold line 201, generally perpendicular to first vertical fold line 201 to the left edge of adhesive tab 250. This configuration for perforation line 215 allows top panel 210 to be removed except for two triangular portions 280A and 280B. The removal of top panel 210 provides ready access to the products contained in carton 100 and also displays those products therein. The triangular portions provide support to allow other cartons to be stacked on top of carton 200 when top panel 210 has been removed and carton 100 has been put in its open/display configuration. Importantly, these triangular portions minimize the risk that one carton will fall or otherwise tip into the inside of the carton below it. The size and specific configuration of triangular portions 280A and 280B can be varied by changing the location where perforation line 215 intersects first vertical fold line 201, first horizontal fold line 260 and second horizontal fold line 270. The appropriate size and configuration is determined by striking a balance between larger triangular portions for added stacking surface area and structural integrity to the carton and a large access opening to the inside of the carton and can be varied based on the specific needs of the manufacturer.

To assemble carton 100, blank 200 is folded along first vertical fold line 201, second vertical fold line 202, third vertical fold line 203 and fourth vertical fold line 204 so that each of the adjacent panels, i.e. top panel 210, first end panel 220, bottom panel 230, second end panel 240, and adhesive tab 250 are generally perpendicular to each other. This will put adhesive tab 250 adjacent to second end panel 240 so that first vertical fold line 201 can be aligned with the right edge of second end panel 240. When in this position, adhesive tab 250 can be glued, stapled or otherwise adhered by conventional means to second end panel 240 to form a box configuration that is open on both of its two sides. Thereafter, the top and bottom flaps are folded inward along first horizontal fold line 260 and second horizontal fold line 270. First end panel top flap 220A and second end panel top flap 240A are folded first and then top panel top flap 210A and bottom panel top flap 230A are folded second so that top panel top flap 210A and bottom panel top flap 230A are on the outside of carton 100. Although this is the preferred embodiment, top panel top flap 210A and bottom panel top flap 230A could be folded first so that top panel top flap 210A and bottom panel top flap 230A are on the inside of first end panel top flap 220A and second end panel top flap 240A inside of carton 100. Similarly, first end panel bottom flap 220B and second end panel bottom flap 240B are folded first and then top panel bottom flap 210B and bottom panel bottom flap 230B are folded second so that top panel bottom flap 210B and bottom panel bottom flap 230B are on the outside of carton 100. Again, although this is the preferred embodiment, top panel bottom flap 210B and bottom panel bottom flap 230B could be folded first so that top panel bottom flap 210B and bottom panel bottom flap 230B are on the inside of first end panel bottom flap 220B and second end panel bottom flap 240B inside of carton 100. The top and bottom flaps are glued, stapled or otherwise adhered to each other by standard fastening means. Typically, products to be shipped and handled in carton 100 are placed on bottom panel 230 first and blank 200 is folded around the product. Thus when blank 200 has been folded as described above, the resulting carton 100, with the product contained therein, can be shipped to the ultimate retail destination.

Figure 3:
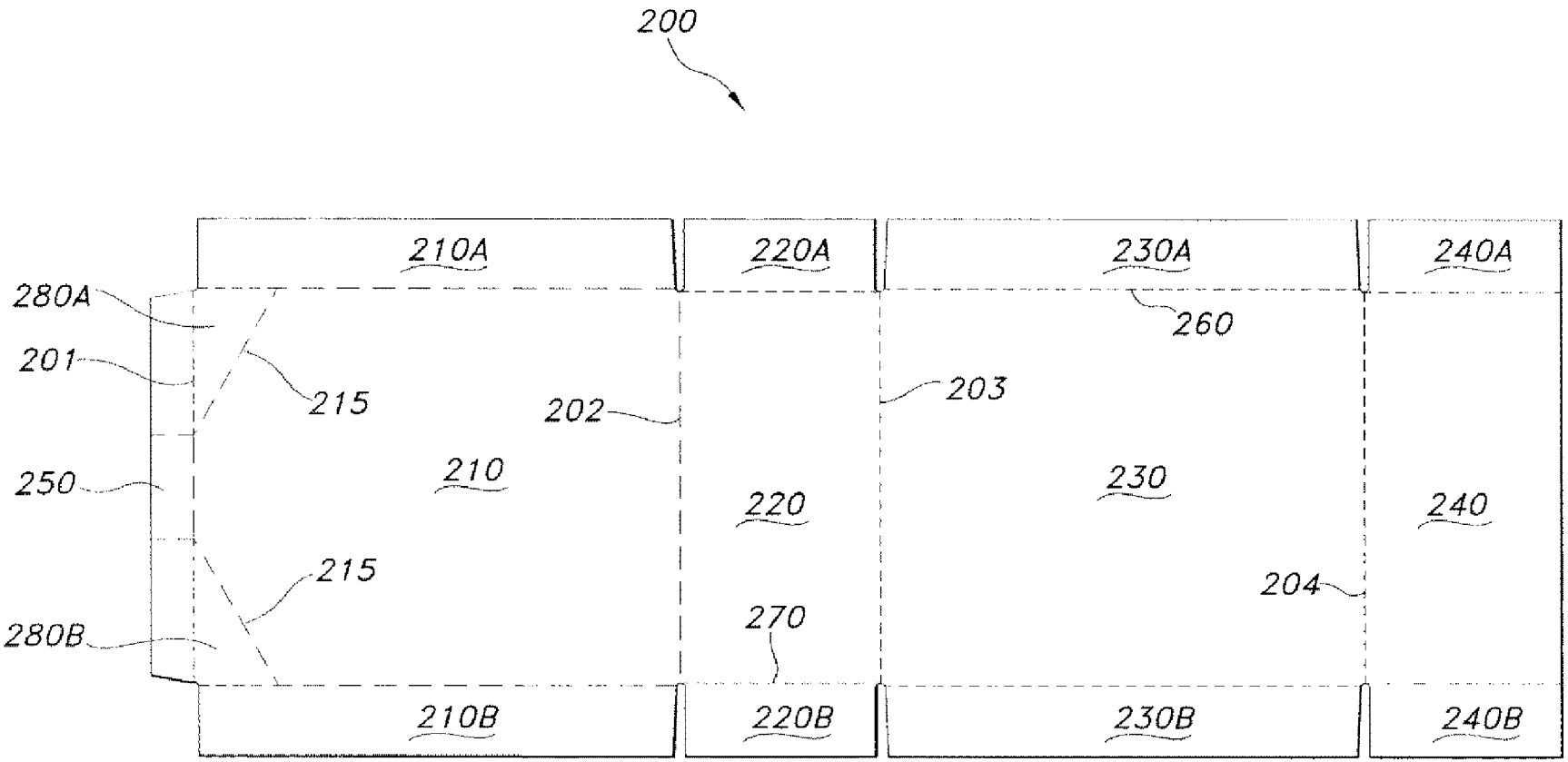
FIG. 3 is plan view of a blank for the carton of FIG. 1.
Figure 4:
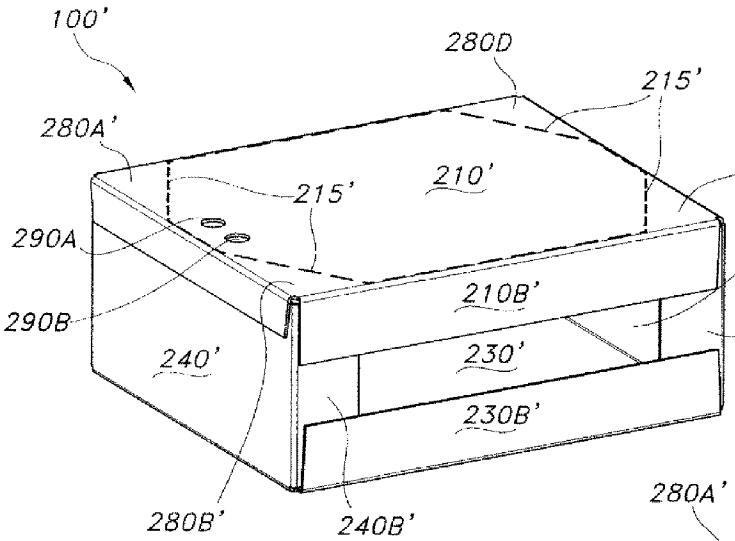
FIG. 4 is perspective view of a second embodiment of the carton of this invention in its shipping configuration.
Figure 5:
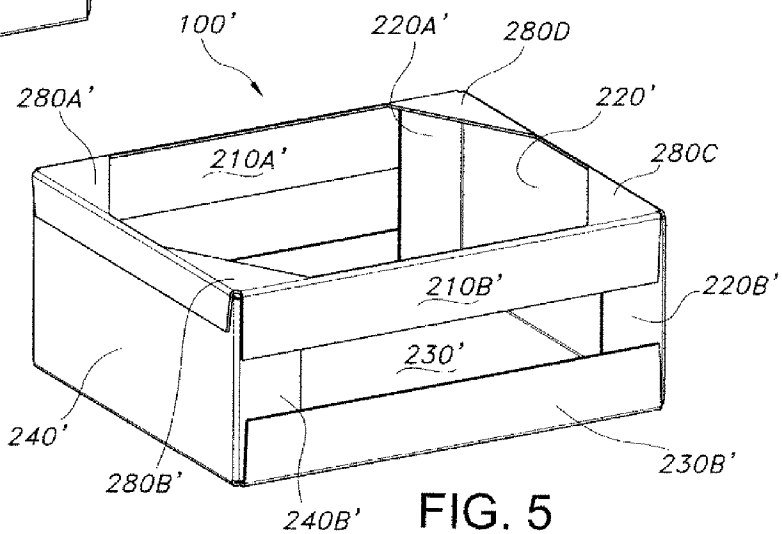
FIG. 5 is a perspective view of the second embodiment of the carton of this invention in its open/display configuration.
Figure 6:
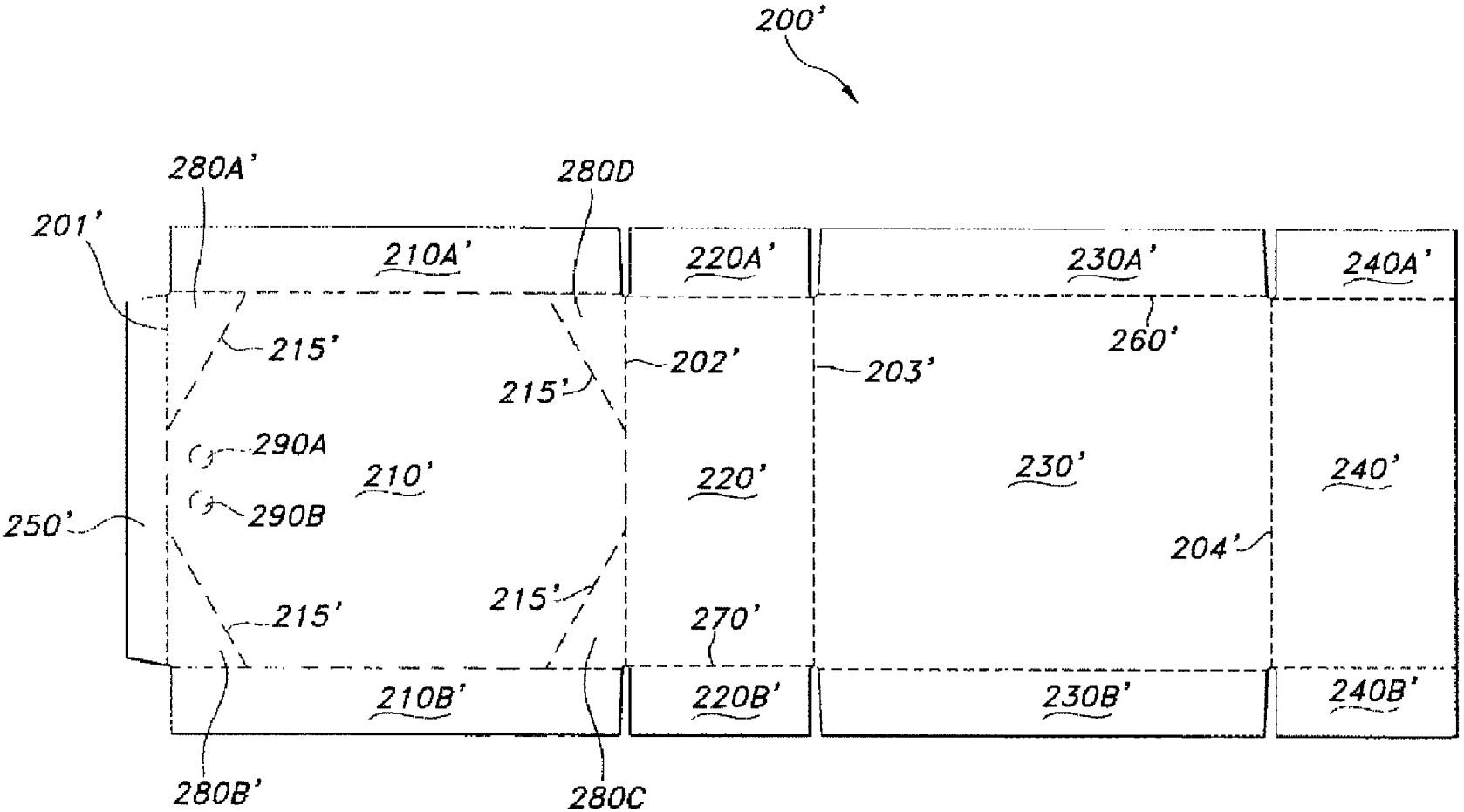
FIG. 6 is a plan view of the blank for the carton of FIG. 4.

A second embodiment of the carton and blank of this invention is shown in FIGS. 4-6, This embodiment is substantially identical to the embodiment of FIGS. 1-3, except in this embodiment the perforation line extends across all four corners of the top of the carton. This provides even greater surface stacking area and structural integrity to the carton. Because of the similarity between this embodiment and the embodiment of FIGS. 1-3, the same reference numbers used for describing the embodiment of FIGS. 1-3 will be used to describe the same features of the embodiment of FIGS. 4-6 except that a prime (') will be used to indicate that those items are for the different embodiment.

Blank 200' includes four main panels, a top panel 210', a first end panel 220', a bottom panel 230' and a second end panel 240'. Blank 200' also includes an adhesive tab 250', which is connected along its right side to the left side of top panel 210' along a first vertical fold line 201'. Top panel 210' is connected along its right side to the left side of first end panel 220' along a second vertical fold line 202'. First end panel 220' is connected along its right side to the left side of bottom panel 230' along a third vertical fold line 203'. Bottom panel 230' is connected along its right side to the left side of second end panel 240' along a fourth vertical fold line 204'. Each of top panel 210', first end panel 220', bottom panel 230', and second end panel 240' includes a top flap defined above a first horizontal fold line 260' and a bottom flap defined below a second horizontal fold line 270'. Top panel top flap 210A' is adjacent to top panel 210' above first horizontal fold line 260' while top panel bottom flap 210B' is adjacent to top panel 210' below second horizontal fold line 270'. First end panel top flap 220A' is adjacent to first end panel 220' above first horizontal fold line 260' while first end panel bottom flap 220B' is adjacent to first end panel 220' below second horizontal fold line 270'. Bottom panel top flap 230A' is adjacent to bottom panel 230' above first horizontal fold line 260' while bottom panel bottom flap 230B' is adjacent to bottom panel 230' below second horizontal fold line 270'. Second end panel top flap 240A' is adjacent to second end panel 240' above first horizontal fold line 260' while second end panel bottom flap 240B' is adjacent to second end panel 240' below second horizontal fold line 270'.

Preferably, all of the top and bottom flaps, i.e. top panel top flap 210A', top panel bottom flap 210B', first end panel top flap 220A', first end panel bottom flap 220B', bottom panel top flap 230A', bottom panel bottom flap 230B', second end panel top flap 240A', and second end panel bottom flap 240B' have substantially the same height. Preferably, top panel top flap 210A', top panel bottom flap 210B', bottom panel top flap 230A' and bottom panel bottom flap 230B' have substantially the same width. Preferably, first end panel top flap 220A', first end panel bottom flap 220B', second end panel top flap 240A' and second end panel bottom flap 240B' also have substantially the same width.

Perforation line 215' is formed in top panel 210' and extends diagonally across all four corners of that panel. Preferably, perforation line 215' extends from an upper portion of the left end of adhesive tab 250' generally perpendicular thereto to first vertical fold line 201', then diagonally to a left portion of first horizontal fold line 260', along first horizontal fold line 260' to a right portion thereof in top panel 210', then diagonally to an upper portion of second vertical fold line 202', along second vertical fold line 202' toward second horizontal fold line 270', theii at a lower portion of second vertical fold line 202' diagonally to second horizontal fold line 270' along a right portion thereof in top panel 210', along second horizontal fold line 270' toward adhesive tab 250', then, along a left portion of second horizontal fold line 270' diagonally to a lower portion of first vertical line 201' and then, at a point along the lower portion of first vertical fold line 201', generally perpendicular to first vertical fold line 201' to the left edge of adhesive tab 250'. This configuration for perforation line 215' allows top panel 210' to be removed except for four triangular portions 280A', 280B', 280C and 280D. The removal of top panel 210' provides ready access to the products contained in carton 100' and also displays those products therein. The triangular portions provide support to allow other cartons to be stacked on top of carton 200' when top panel 210' has been removed and carton 100' has been put in its open/display configuration. Again, as with the embodiment of FIGS. 1-3, the specific size and configuration of triangular portions 280A', 280B', 280C and 280D can be varied by varying the location where perforation line 215' intersects first vertical fold line 201', first horizontal fold line 260', second vertical fold line 202' and second horizontal fold line 270'. Although the embodiments shown have four and two triangular portions, this invention also encompasses the use of one or three triangular portions.

A pair of cut outs 290A and 290B can be formed along a left side of the portion of top panel 210' that is to be removed. Cut outs 290A and 290B facilitate manipulation of top panel 210' to allow a user to remove a portion of top panel 210' to provide access to the interior of the carton. Such cut outs can also be incorporated into the carton and blank of the embodiment of FIGS. 1-3.

To assemble carton 100', blank 200' is folded along first vertical fold line 201', second vertical fold line 202', third vertical fold line 203' and fourth vertical fold line 204' so that each of the adjacent panels, i.e. top panel 210', first end panel 220', bottom panel 230', second end panel 240'and adhesive tab 250' are generally perpendicular to each other. This will put adhesive tab 250' adjacent to second end panel 240' so that first vertical fold line 201' can be aligned with the right edge of second end panel 240'. When in this position, adhesive tab 250' can be glued, stapled or otherwise adhered by conventional means to second end panel 240' to form a box configuration that is open on both of its two sides. Thereafter, the top and bottom flaps are folded inward along first horizontal fold line 260' and second horizontal fold line 270'. First end panel top flap 220A' and second end panel top flap 240A' are folded first and then top panel top flap 210A' and bottom panel top flap 230A' are folded second so that top panel top flap 210A' and bottom panel top flap 230A' are on the outside of carton 100'. Although this is the preferred embodiment, top panel top flap 210A' and bottom panel top flap 230A' could be folded first so that top panel top flap 210A' and bottom panel top flap 230A' are on the inside of first end panel top flap 220A' and second end panel top flap 240A' inside of carton 100'. Similarly, first end panel bottom flap 220B' and second end panel bottom flap 240B' are folded first and then top panel bottom flap 210B' and bottom panel bottom flap 230B' are folded second so that top panel bottom flap 210B' and bottom panel bottom flap 230B' are on the outside of carton 100'. Again, although this is the preferred embodiment, top panel bottom flap 210B' and bottom panel bottom flap 230B' could be folded first so that top panel bottom flap 210B' and bottom panel bottom flap 230B' are on the inside of first end panel bottom flap 220B' and second end panel bottom flap 240B' inside of carton 100'. The top and bottom flaps are glued, stapled or otherwise adhered to each other by standard fastening means.

Figure 7:
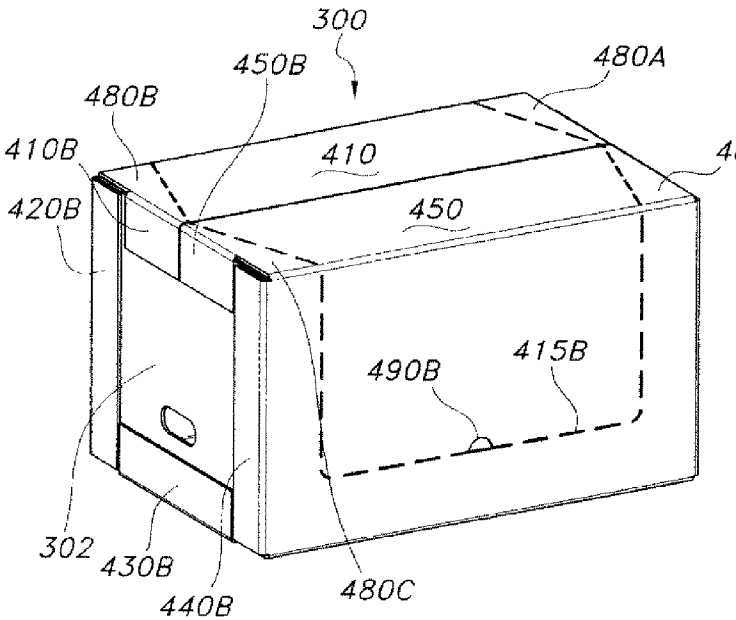
FIG. 7 is perspective view of a third embodiment of the carton of this invention in its shipping configuration.
Figure 8:
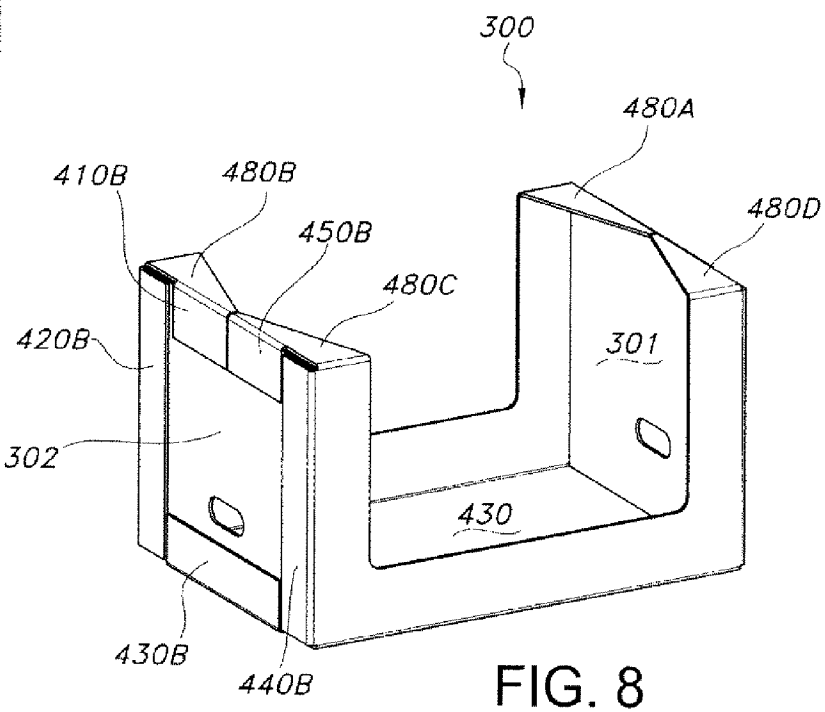
FIG. 8 is a perspective view of the third embodiment of the carton of this invention in its open/display con figuration.
Figure 9:
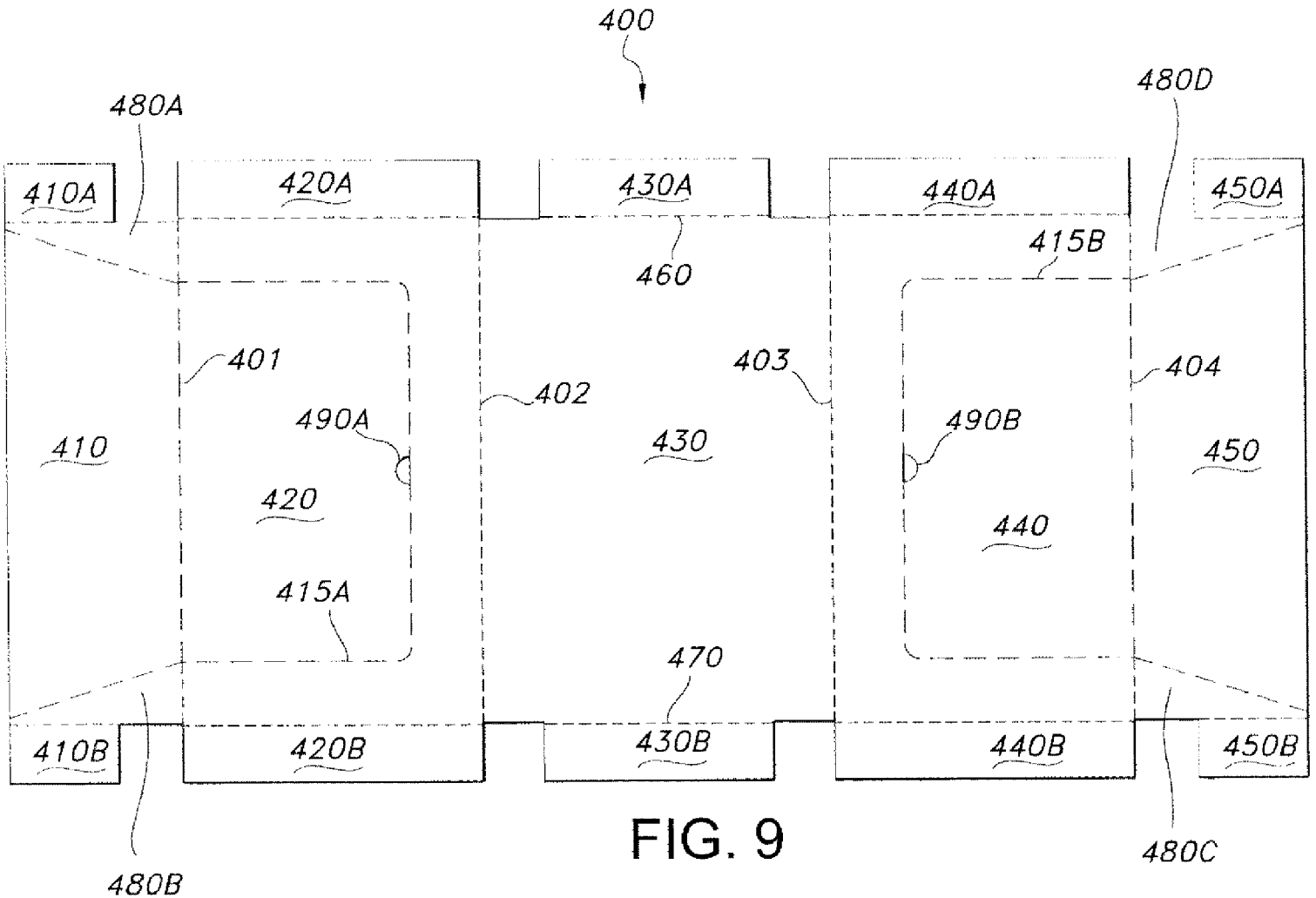
FIG. 9 is a plan view of the blank for the carton of FIG. 7.

In the third embodiment of the carton of this invention shown in FIGS. 7-8, the carton 300 is assembled by folding and adhering together portions of the blank 400. Blank 400 includes five main panels, a first top panel 410, a first side panel 420, a bottom panel 430, a second side panel 440 and a second top panel 450. First top panel 410 is connected along its right side to the left side of first side panel 420 along a first vertical fold line 401. First side panel 420 is connected along its right side to the left side of bottom panel 430 along a second vertical fold line 402. Bottom panel 430 is connected along its right side to the left side of second side panel 440 along a third vertical fold line 403. Second side panel 440 is connected along its right side to the left side of second top panel 450 along fourth vertical line 404. Each of first top panel 410, first side panel 420, bottom panel 430, second side panel 440 and second top panel 450 includes a top flap defined above a first horizontal fold line 460 and a bottom flap defined below a second horizontal fold line 470. First top panel top flap 410A is adjacent to first top panel 410 above first horizontal fold line 460 while first top panel bottom flap 410B is adjacent to first top panel 410 below second horizontal fold line 470. First side panel top flap 420A is adjacent to first side panel 420 above first horizontal fold line 460 while first side panel bottom flap 420B is adjacent to first side panel 420 below second horizontal fold line 470. Bottom panel top flap 430A is adjacent to bottom panel 430 above first horizontal fold line 460 while bottom panel bottom flap 430B is adjacent to bottom panel 430 below second horizontal fold line 470. Second side panel top flap 440A is adjacent to second side panel 440 above first horizontal fold line 460 while second side panel bottom flap 440B is adjacent to second side panel 440 below second horizontal fold line 270. Second top panel top flap 450A is adjacent to second top panel 450 above first horizontal fold line 460 while second top panel bottom flap 450B is adjacent to second top panel 450 below second horizontal fold line 470.

Preferably, all of the top and bottom flaps, i.e. first top panel top flap 410A, first top panel bottom flap 410B, first side panel top flap 420A, first side panel bottom flap 420B, bottom panel top flap 430A, bottom panel bottom flap 430B, second side panel top flap 440A, second side panel bottom flap 440B, second top panel top flap 450A and second top panel bottom flap 450B have substantially the same height. Preferably, first top panel top flap 410A, first top panel bottom flap 410B, second top panel top flap 450A and second top panel bottom flap 450B have substantially the same width. Preferably, first side panel top flap 420A, first side panel bottom flap 420B, second side panel top flap 440A and second side panel bottom flap 440B also have substantially the same width. Preferably, bottom panel top flap 430A and bottom panel bottom flap 430B have substantially the same width.

Perforation line 415A extends across first top panel 410 and first side panel 420. Similarly. perforation line 415B extends across second top panel 450 and second side panel 440. Perforation lines 415A and 415B extend diagonally across the top and bottom of first top panel 410 and second bottom panel 450 respectively. This allows four triangular portions 480A, 480B, 480C, and 480D to be formed in the top corners of carton 300. As with the other embodiments, the specific size and configuration of triangular portions 480A, 480B, 480C and 480D can be varied by varying the location where perforation lines 415A and 415B intersect first horizontal fold line 460, second horizontal fold line 470 and, in the case of triangular portions 480A and 480B, first vertical fold line 401 and, in the case of triangular portions 480C and 480D, fourth vertical fold line 404. Although preferably four triangular portions are used, this invention contemplates the use of one, two or three triangular portions as well. Specifically, perforation line 415A extends from an upper portion of the left end of first top panel 410 diagonally down to first vertical fold line 401, then generally perpendicular thereto to a right portion of first side panel 420, then generally vertically toward second horizontal fold line 470, then generally horizontally to first vertical fold line 401 along a lower portion thereof and then diagonally across first top panel 410 to a lower portion of the left edge of first top panel 410. Notch 490A may be formed in first side panel 420 along perforation line 415A to facilitate tearing of blank 400 along perforation line 415A. Instead of extending to the left edge of first top panel 410, perforation line 415A could intersect first horizontal fold line 460 and second horizontal fold line 470 anywhere along their length in first top panel 410. Perforation line 415B is preferably a mirror image of perforation line 415A. Specifically, perforation line 415B extends from an upper portion of the right edge of second top panel 450 diagonally down to fourth vertical fold line 404, then generally perpendicular thereto to a left portion of second side panel 440, then generally vertically toward second horizontal fold line 470, then generally horizontally to fourth vertical fold line 404 along a lower portion thereof and then diagonally across second top panel 450 to a lower portion of the right edge of second top panel 450. Notch 490B may be formed in second side panel 440 along perforation line 415BA to facilitate tearing of blank 400 along perforation line 415B. Again, instead of extending to the right edge of second top panel 450, perforation line 415B could intersect first horizontal fold line 460 and second horizontal fold line 470 anywhere along their length in second top panel 450. The removal of portions of first top panel 410, first side panel 420, second side panel 440 and second top panel 450 provides ready access to the products contained in carton 300 and also displays those products therein. The tri angular portions provide support to allow other cartons to be stacked on top of carton 300 when it has been put in its open/display configuration. Although this embodiment is described with two perforation lines 415A and 415B, it is within the scope of this invention to use only one of the perforation lines. In addition, it is within the scope of this invention to have perforation lines 415A and 415B extend only along top panels 410 and 450 respectively. In such an embodiment, perforation line 415A would extend vertically along first vertical fold line 401, or along a right portion of top panel 410, and would not extend into first end panel 420. Similarly, perforation line 415B would extend vertically along fourth vertical fold line 404, or along a left portion of second top panel 450 and would not extend into second end panel 440.

To assemble carton 300, blank 400 is folded along first vertical fold line 401, second vertical fold line 402, third vertical fold line 403 and fourth vertical fold line 404 so that each of the adjacent panels, i.e. first top panel 410, first side panel 420, bottom panel 430, and second side panel 440 are generally perpendicular to each other. Second top panel 450 would be generally perpendicular to second side panel 440 but generally aligned with first top panel 410. This will put the left edge of first top panel 410 in proximity to the right edge of second top panel 450. When in this position, the top and bottom flaps may be folded inward along first horizontal fold line 460 and second horizontal fold line 470. First top panel top flap 410A, first side panel top flap 420A, bottom panel top flap 430A, second side panel top flap 440A and second top panel top flap 450A are folded and adhered by standard means to a separate end panel (301 in FIG. 8) in standard bliss type carton fabrication technique. Similarly, first top panel bottom flap 410B, first side panel bottom flap 420B, bottom panel bottom flap 430B, second side panel bottom flap 440B and second top panel bottom flap 450B are folded and adhered by standard means to a separate side panel (302 in FIGS. 7 and 8) in standard bliss type carton fabrication technique. Typically, products to be shipped and handled in carton 300 are placed on bottom panel 430 first and blank 400 is folded around the product. Thus when blank 400 has been folded as described above, the resulting carton 300, with the product contained therein, can be shipped to the ultimate retail destination While the present invention has been described in connection with the illustrated embodiments, it will be appreciated and understood that modifications may be made without departing from the true spirit and scope of the invention.

We claim:

1. A blank, comprising:

a top panel having a top portion, a top edge, a bottom portion, a bottom edge, a right portion, a right edge, a left portion and a left edge, the top panel having a characteristic strip dimension defined by a distance between the top edge and the bottom edge;

a first end panel having a right edge and a left edge connected to the right edge of the top panel;

a bottom panel having a left edge connected to the right edge of the first end panel and a right edge;

a second end panel having a top portion, a bottom portion, a left edge connected to the right edge of the bottom panel and a right edge;

a top panel top flap connected to the top panel with a first fold line therebetween, a first end panel top flap connected to the first end panel with the first fold line therebetween, a bottom panel top flap connected to the bottom panel with the first fold line therebetween, and a second end panel top flap connected to the second end panel with the first fold line therebetween, wherein all of the top flaps are the same height having a dimension less than half the characteristic strip dimension so as to provide a first centrally disposed partially open side to a carton when the blank is folded;

a top panel bottom flap connected to the top panel with a second fold line therebetween, a first end panel bottom flap connected to the first end panel with the second fold line therebetween, a bottom panel bottom flap connected to the bottom panel with the second fold line therebetween, and a second end panel bottom flap connected to the second end panel with the second fold line therebetween, wherein all of the bottom flaps are the same height having a dimension less than half the characteristic strip dimension so as to provide a second centrally disposed partially open side to a carton when the blank is folded; and a perforation line extending from the left portion of the top panel diagonally across the top portion of the top panel to and along the top portion of the top panel, to and along the right portion of the top panel, to and along the bottom portion of the top panel.

2. The blank of claim 1 wherein the perforation line extends diagonally across the bottom portion of the top panel.

3. The blank of claim 1 wherein the perforation line extends diagonally across the top portion of the top panel and the left portion of the top panel.

4. The blank of claim 3 wherein the perforation line extends diagonally across the bottom portion of the top panel and the left portion of the top panel.

5. The blank of claim 4 wherein the perforation line extends diagonally across the top portion of the top panel and the right portion of the top panel.

6. The blank of claim 4 wherein the perforation line extends from the right edge diagonally across the bottom portion of the top panel and the right portion of the top panel.

7. A carton, comprising:

a bottom panel having a first edge and a second edge;

a first side panel having a left end, a right end, a top edge and a bottom edge, the first side panel connected to the bottom panel along one of the first edge and the second edge, the first side panel having a removable portion inboard of its left end, right end and bottom edge;

a second side panel having a left end, a right end, a top edge and a bottom edge, the second side panel connected to the bottom panel along the other of the first edge and the second edge;

a first top panel having a first edge and a second edge, the first edge of the first top panel being contiguous with the top edge of the first panel, a left end and a right end connected to the left end and the right end, respectively, of the first side panel at the top edge of the first side panel, the first top panel having a removable portion inboard of its left end right end, the removable portion of the first top panel being contiguous with the removable portion of the first side panel;

a second top panel having a first edge and a second edge, the first edge of the second top panel being contiguous with the top edge of the second panel, a left end and a right end connected to the left end and the right end, respectively, of the second side panel at the top edge of the second side panel;

the second edge of the first top panel being juxtaposed with the second edge of the second top panel;

a left end panel comprising a first portion contiguous with the first top panel, a second portion contiguous with the first side panel, a third portion contiguous with the bottom panel, a fourth portion contiguous with the second side panel, a fifth portion contiguous with the second top panel, and a left end insert fixedly attached to the first, second, third, fourth and fifth portions, wherein the first portion and the fifth portion are juxtaposed; and a right end panel comprising a sixth portion contiguous with the first top panel, a seventh portion contiguous with the first side panel, an eighth portion contiguous with the bottom panel, a ninth portion contiguous with the second side panel, a tenth portion contiguous with the second top panel, and a right end insert fixedly attached to the sixth, seventh, eighth, ninth and tenth portions, wherein the sixth portion and the tenth portion are juxtaposed;

wherein:

the second side panel comprises a removable portion inboard of its left end, right end and bottom edge;

the second top panel comprises a removable portion inboard of its left end and right end, the removable portion of the second top panel being contiguous with the removable portion of the second side panel;

the first top panel comprises a triangular left end non-removable portion and a triangular right end non-removable portion disposed on opposing sides of the removable portion of the first top panel;

the second top panel comprises a triangular left end non-removable portion and a triangular right end non-removable portion disposed on opposing sides of the removable portion of the second top panel;

the triangular left end non-removable portions of the first top panel and the second top panel are juxtaposed to form a connecting bridge across a top edge of the left end panel with a narrow section disposed proximate the second edges of the first top panel and the second top panel; and the triangular right end non-removable portions of the first top panel and the second top panel are juxtaposed to form a connecting bridge across a top edge of the right end panel with a narrow section disposed proximate the second edges of the first top panel and the second top panel.

* * * * *